United States Patent [19]

Barbano

[11] 4,121,215

[45] Oct. 17, 1978

[54] CORNER REFLECTOR ANTENNA FOR DF AND TRACKING APPLICATIONS

[75] Inventor: Normand Barbano, Sunnyvale, Calif.

[73] Assignee: The United States of America as represented by the Secretary of the Army, Washington, D.C.

[21] Appl. No.: 278,493

[22] Filed: Aug. 4, 1972

[51] Int. Cl.[2] ..... H01Q 15/18

[52] U.S. Cl. ..... 343/18 C; 343/18 D; 343/815

[58] Field of Search ..... 343/18 C, 18 D, 815, 343/818

[56] References Cited

U.S. PATENT DOCUMENTS

| | | | |
|---|---|---|---|
| 2,551,586 | 5/1951 | Dobler et al. | 343/815 X |
| 2,823,365 | 2/1958 | Rines | 343/18 D X |
| 3,308,464 | 3/1967 | Lewis | 343/18 D |

*Primary Examiner*—T.H. Tubbesing

*Attorney, Agent, or Firm*—Nathan Edelberg; Robert P. Gibson; Robert C. Sims

[57] ABSTRACT

A corner reflecting antenna is truncated by a reflecting plate. Two rows of dipoles are placed near the throat of the corner reflector (but in front of reflecting plate) and aligned parallel to sides of the antenna. The dipoles are placed at locations that are near multiples of odd quarter-wavelengths from the truncated surfaces. Dipoles lie in the same plane parallel to the truncated surface and equidistant from the sides of the antenna. The rows of the dipoles fed separately by way of two power splitters, a phase shifter and a magic-tee.

3 Claims, 4 Drawing Figures

CORNER REFLECTOR ANTENNA FOR DF AND TRACKING APPLICATIONS

SUMMARY OF THE INVENTION

The antenna consists of a 30° corner reflector that is 45.8 inches long on the sides and 48 inches wide. The feed for this reflector consists of an array of two rows of dipoles with the dipoles aligned parallel to the corner. A reflecting plate is used behind the dipoles and is located 6 inches from the corner. This plate serves to shape the dipole element radiation patterns and to prevent the formation of a trapped wave between the dipoles and the corner of the antenna. The dipoles are spaced 1.4 inches in front of the reflecting plate.

There are a total of eight dipoles, four in each row, that are displaced 1.8 inches from each other. The separation between the rows is 1.2 inches. The dipoles lie on the bisector of their nearest corner formed by the reflecting plate and the antenna, and they are spaced one-half wavelength from this corner. The furthest corner from the dipoles is three-quarters of a wavelength.

Each row of dipoles is fed in phase and with equal amplitude from a four-way power splitter. The power splitter is fed by a magic-tee from a transmitter not shown. A phase shifter is inserted between one power splitter and the magic-tee. When operating in the receive mode the magic-tee feeds a receiver by way of a sum and difference port. With this circuit, two modes of operation of the antenna for the vertical plane are developed.

Monopulse beams for the first mode are formed by adjusting the phase shifter for zero phase shift and viewing the outputs at the sum and difference ports of the magic-tee. The two overlapping beams for the second mode of operation are formed independently. A positive phase shift is introduced to obtain a beam shift off the antenna boresight in one direction, and an equal, negative phase shift is used to achieve the beamshift in the opposite direction. The output is taken from the sum port of the magic-tee while the difference port is terminated in a 50-ohm load (not shown). A squinted beam may also be formed by exciting only one row of the dipole array in the reflector and terminating the output of the other row in a resistive load.

DESCRIPTION OF THE PREFERRED EMBODIMENT

Figure 3:
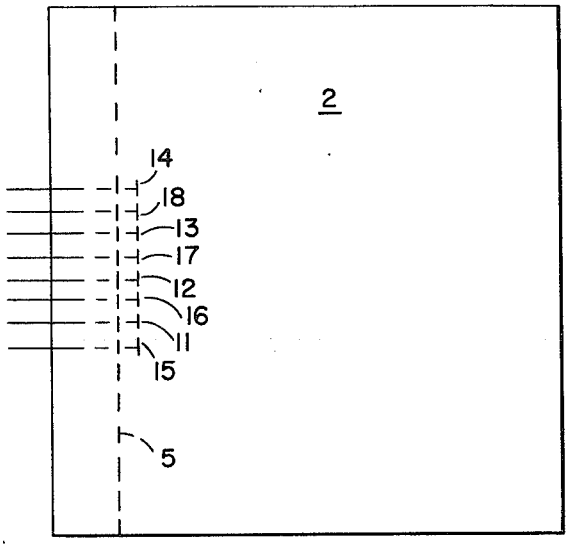
FIGS. 1–3 show respectively top, front, and side diagrammatic views of the preferred invention.
Figure 2:
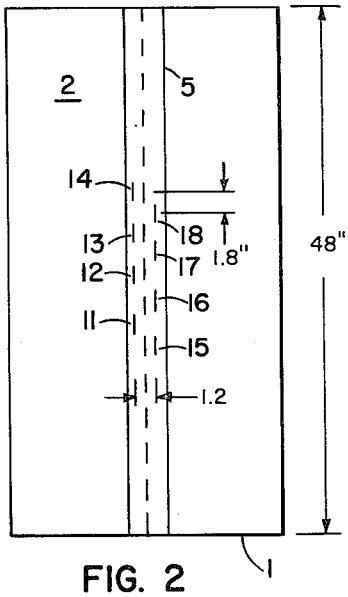
Figure 1:
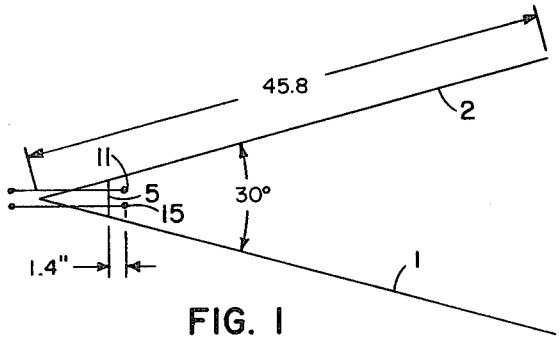

A corner reflector antenna is shown in FIGS. 1–3 to be made up of two sides 1 and 2, a reflector plate 5, and two rows of dipole antennas 11–18. The antenna can be used in directional finding "DF", radar, and guidance systems. The preferred embodiment shown in FIGS. 1–3 is directed to a corner reflector antenna designed to operate over the frequency range of 3.4 to 3.6 GHz. The angle is 30° between the sides of the reflector which are in turn 45.8 inches long and 48 inches high. The two arrays of dipoles 11–18 are aligned parallel to the corner. A reflecting plate 5 is used behind the dipoles at a distance 6 inches from the corner. This plate serves to shape the dipole element radiation patterns and to prevent the formation of a trapped wave between the dipoles and the corner of the antenna. The dipoles are spaced 1.4 inches in front of the reflecting plate 5. There are a total of eight dipoles, four in each row, that are displaced 1.8 inches from each other. The separation between the rows is 1.2 inches. The dipoles lie on the bisector of their nearest corner formed by the reflecting plate 5 and the sides of the antenna 1 and 2. The dipoles are spaced one-half wavelength of the operation frequency from this corner. The furthest corner from the dipoles is three-quarters of a wavelength. For example dipole 11 is one-half wavelength from the corner formed by plate 5 and side 2 and three-quarters of a wavelength from the corner formed by plate 5 and side 1.

Figure 4:
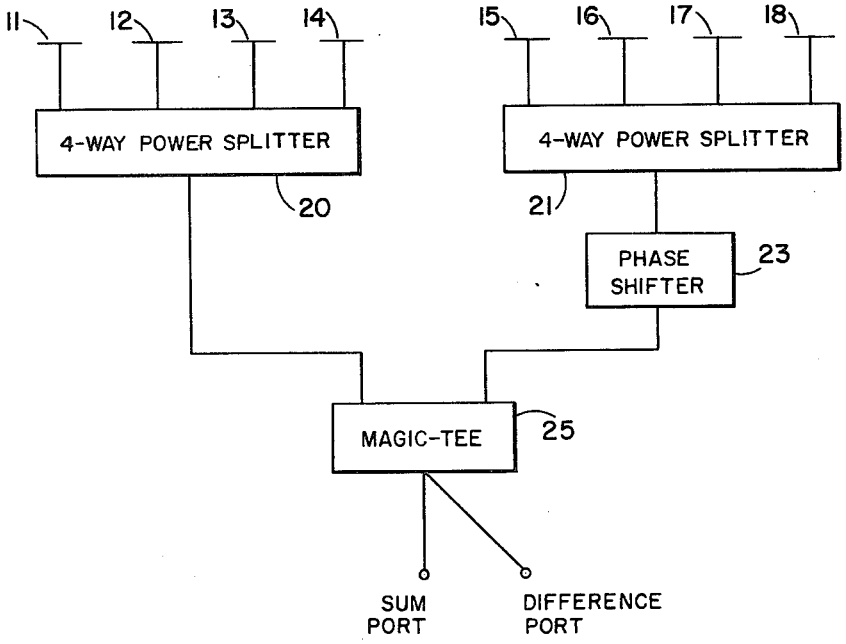
FIG. 4 is a schematic showing of the electrical system feeding the antenna of FIGS. 1–3.

FIG. 4 shows that each row of dipoles is fed in phase and with equal amplitude from two four-wave power splitters 20 and 21. Any of the well known four-wave power splitters may be used. A variable phase shifter 23 is inserted between the feed from four-way power splitter 21 and magic-tee 25. Any of the well known phase shifters and magic-tees may be used. The feed from the other four-way power splitter 20 is also fed to magic-tee 25. A transmitter (not shown) feeds magic-tee 25 to power the dipole arrays. Further, in the receiving mode a sum port and a difference port are provided on the magic-tee to supply the receiver (not shown). With this circuit, two modes of operation of the antenna for the vertical plane can be developed.

Monopulse beams in the first mode are formed by adjusting the phase shifter 23 for zero phase shift and viewing the outputs at the sum and different ports of the magic-tee. The resulting radiation patterns of this monopulse mode of operation can be used to provide good target resolution in a tracking radar application over a ± 10 degree elevation section.

In a sequential lobing radiation pattern mode two overlapping beams are formed independently. Positive phase shift is introduced by phase shifter 23 to obtain a beam shift off the antenna boresight in one direction, and an equal, negative phase shift is used to achieve the beamshift in the opposite direction. With this mode the output is taken from the sum port of the magic-tee while the difference port is terminated in a 50-ohm load (not shown).

The corner reflector therefore forms monopulse and sequential lobing radiation patterns in the plane perpendicular to the corner reflector surfaces. Both modes produce radiation patterns which are horizontally polarized.

I claim:

1. A corner reflector comprising first and second sides connected together at one end to form a throat of the corner reflector; a reflector plate mounted to said first and second sides near said throat and parallel to a line formed by the junction of said first and second sides to each other; and at least first and second dipoles mounted in front of the reflector plate.

2. A reflector as set forth in claim 1 wherein said dipoles consists of first and second arrays of dipoles arranged in first and second rows parallel to the reflecting plate, the sides, and to each other; said reflecting plate truncating said reflector and forming first and second corners where they join said sides; said first row of dipoles being located one-quarter of a predetermined wavelength from said first corner and three-quarters of said wavelength from said second corner; said second row of dipoles being three-quarters of said wavelength from said first corner and one-quarter of said wavelength from said second corner; and the reflecting plate is located a distance from the line formed by the two sides joining which will prevent the formation of a trapped wave between the dipole and the throat of the antenna.

3. A reflector as set forth in claim 2 further comprising first and second power splitters connected respectively to said first and second row of dipoles; a magic-tee; a phase shifter; said magic-tee being connected directly to said first power splitter and connected through said phase shifter to said second power splitter; and said magic-tee being adapted to feed power or receive power from said dipoles.

* * * * *